US009248890B2

(12) United States Patent
Raaphorst

(10) Patent No.: US 9,248,890 B2
(45) Date of Patent: Feb. 2, 2016

(54) STANDUP PADDLE BOARD SYSTEM WITH STEERING MECHANISM

(71) Applicant: Flow Sports, Inc., San Clemente, CA (US)

(72) Inventor: Mark Raaphorst, San Clemente, CA (US)

(73) Assignee: Flow Sports, Inc., San Clemente, CA (US)

( * ) Notice: Subject to any disclaimer, the term of this patent is extended or adjusted under 35 U.S.C. 154(b) by 305 days.

(21) Appl. No.: 13/919,869

(22) Filed: Jun. 17, 2013

(65) Prior Publication Data

US 2013/0344758 A1 Dec. 26, 2013

Related U.S. Application Data

(60) Provisional application No. 61/663,404, filed on Jun. 22, 2012.

(51) Int. Cl.

| | |
|---|---|
| ***B63B 1/10*** | (2006.01) |
| ***B63B 35/79*** | (2006.01) |
| ***B63H 25/10*** | (2006.01) |
| ***B63B 1/12*** | (2006.01) |
| ***B63H 25/06*** | (2006.01) |
| ***B63H 25/02*** | (2006.01) |

(52) U.S. Cl.

CPC ..... *B63B 35/7926* (2013.01); *B63B 1/10* (2013.01); *B63B 1/12* (2013.01); *B63B 1/121* (2013.01); *B63B 35/7906* (2013.01); *B63H 25/02* (2013.01); *B63H 25/06* (2013.01); *B63B 35/792* (2013.01); *B63H 2025/028* (2013.01); *B63H 2025/066* (2013.01)

(58) Field of Classification Search

CPC ..... B63B 1/121; B63B 2001/205; B63B 2001/206; B63B 35/79; B63B 2035/7903; B63B 35/7906; B63B 35/792; B63B 35/7926; B63B 35/7953; B63B 35/7993; B63B 1/10; B63B 1/12; B63B 2001/123; B63H 25/02; B63H 2025/028; B63H 25/06; B63H 2025/066

USPC ..... 114/39.12–39.15, 39.26, 39.27, 61.1, 114/61.22–61.25, 144 R, 153; 441/74, 79

See application file for complete search history.

(56) References Cited

U.S. PATENT DOCUMENTS

| | | | | |
|---|---|---|---|---|
| 996,444 | A | 6/1911 | Yarrington | |
| 2,153,939 | A * | 4/1939 | Schaupp | 441/77 |
| 4,286,533 | A * | 9/1981 | Sanner | 114/39.28 |
| D293,096 | S * | 12/1987 | Keller | D12/304 |
| D301,226 | S * | 5/1989 | Wood, Jr. | D12/304 |
| 6,183,333 | B1 | 2/2001 | Hall | |
| 6,199,499 | B1 * | 3/2001 | Horais | 114/162 |
| 2010/0203778 | A1 | 8/2010 | Ketterman et al. | |

* cited by examiner

*Primary Examiner* — Ajay Vasudeva

(74) *Attorney, Agent, or Firm* — Mintz Levin Cohn Ferris Glovsky and Popeo, P.C.

(57) ABSTRACT

The systems and methods described herein are directed to a standup paddle board system including a multi-hull board and a steering mechanism which can be activated by a user and assist in maneuvering the standup paddle board system. In addition, one or more moveable rudders can extend from a bottom surface of the multi-hull board and can change position in response to activation of the steering mechanism. In at least some variations, activation of the steering mechanism, such as a steering arm or tiller, can effectuate simultaneous movement of two or more moveable rudders.

13 Claims, 5 Drawing Sheets

STANDUP PADDLE BOARD SYSTEM WITH STEERING MECHANISM

REFERENCE TO PRIORITY DOCUMENT

This application claims priority benefit under 35 U.S.C. §119 (e) of U.S. Provisional Patent Application Ser. No. 61/663,404, filed Jun. 22, 2012, and entitled "Standamaran System With Steering Mechanism." The priority of the filing date of Jun. 22, 2012 is hereby claimed, and the disclosure of the provisional patent application is hereby incorporated by reference in its entirety.

FIELD

The subject matter described herein relates to systems and methods for standup paddle boarding, including a standup paddle board system. In addition, the standup paddle boarding system can include a multi-hull board and a steering mechanism which can control the movement and positioning of at least one moveable rudder extending from the multi-hull board.

BACKGROUND

Stand up paddle boarding is a popular water sport that can be enjoyed in a variety of bodies of water around the world, such as lakes, rivers and oceans. At least some standup paddle boards allow a user to stand on the standup paddle board and use a paddle to assist in propelling and directing the standup paddle board along the body of water.

In addition, due to the size of most standup paddle boards, including some catamaran style standup paddle boards, changing the direction of travel of the standup paddle board can be difficult. For example, a user of a standup paddle board can expend a significant amount of energy in order to either propel or change the direction of travel of the standup paddle board. Therefore, it can be beneficial for a user to have assistance in at least changing the direction of travel of the standup paddle board in order to at least preserve some of the user's energy and improve the speed and efficiency of the standup paddle board.

SUMMARY

At least some embodiments disclosed herein include a standup paddle board system comprising a multi-hull board having at least two hulls joined by at least one connecting structure. In addition, at least one moveable rudder can extend from a bottom surface of the multi-hull board. Additionally, the system can include a steering mechanism having at least one steering arm configured to control at least one of a movement and positioning of the at least one moveable rudder.

Also described herein are methods of providing and using the standup paddle board system. In an embodiment, disclosed is a method including providing a standup paddle board system comprising a multi-hull board including at least two hulls joined by at least one connecting structure and at least one moveable rudder extending from a bottom surface of the multi-hull board. In addition, the standup paddle board system can further comprise a steering mechanism including at least one steering arm configured to control at least one of a movement and positioning of the at least one moveable rudder. The method also includes simultaneously changing the position of at least two moveable rudders upon activation of the steering mechanism.

The details of one or more variations and implementations of the standup paddle board system and methods are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Described herein is a standup paddle board system including a multi-hull board and a steering mechanism which can assist a user in maneuvering the standup paddle board system. The multi-hull board can include at least two hulls connected by at least one connecting structure. In addition, the steering mechanism can include a steering arm, or tiller, which can control the movement and positioning of at least one moveable rudder extending from a bottom surface of the multi-hull board. The steering arm can either directly, such as mechanically, or wirelessly control the movement and position of the at least one moveable rudder.

Additionally, in at least some variations, the steering mechanism can be configured to be activated by a user, such as by moving the steering arm, in order to effectuate a simultaneous change in position of at least two moveable rudders relative to the bottom surface of the multi-hull board. The ability of the user to change the position of at least one moveable rudder can assist the user in more efficiently maneuvering and directing the propulsion of the standup paddle board system.

Figure 1:
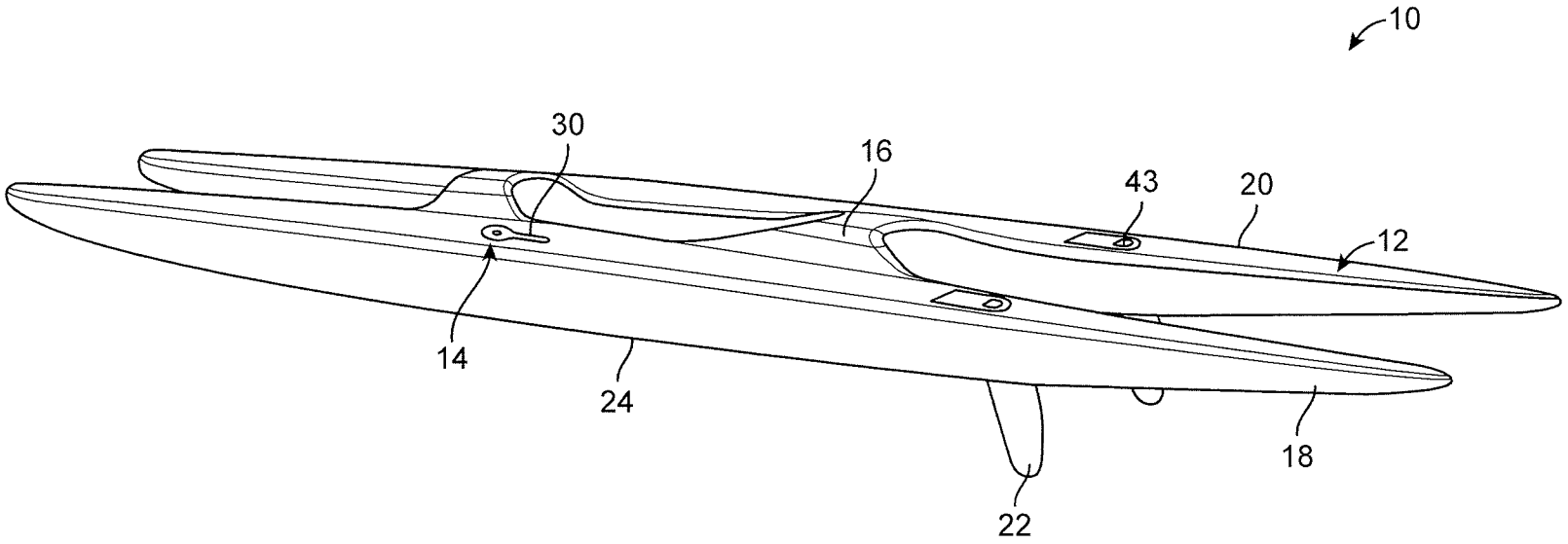
FIG. 1 shows a perspective side view of a variation of a standup paddle board system including a multi-hull board and steering mechanism.

FIG. 1 illustrates an embodiment of a standup paddle board system 10 including a multi-hull board 12 and a steering mechanism 14. The multi-hull board 12 can include more than one pontoon or hull 18 joined together by at least one boom, or connecting structure 16. In addition, the multi-hull board 12 can include at least one moveable rudder 22 which can extend from a bottom surface 24 of the multi-hull board 12.

Figure 2:
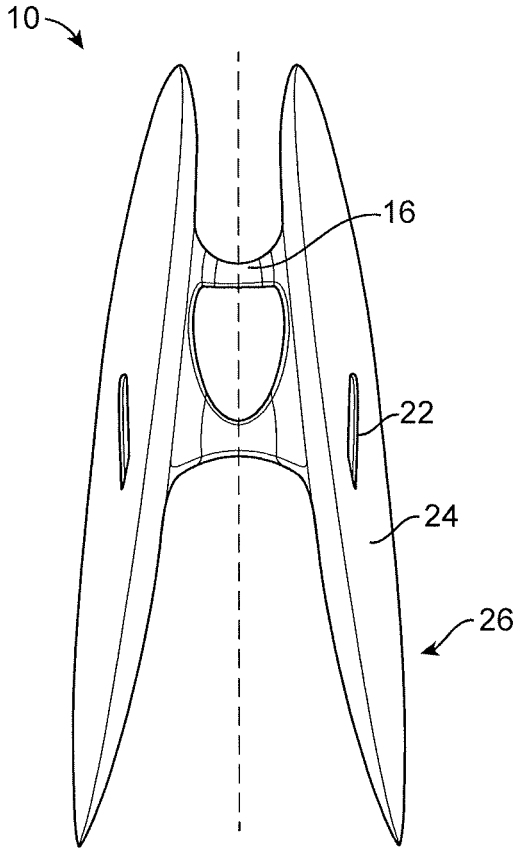
FIG. 2 shows a bottom side view of the standup paddle board system shown in FIG. 1 showing moveable rudders extending from a bottom side of the multi-hull board.

As shown in FIG. 2, a pair of moveable rudders 22 can extend from the bottom surface 24 of the multi-hull board 12 adjacent a back end 26 of the multi-hull board 12. The steering mechanism 14 can control at least the movement and positioning of the moveable rudders 22, including simultaneously controlling the movement and positioning of at least two moveable rudders 22, relative to the bottom surface 24 of the multi-hull board 12. In addition, a change in position of the one or more moveable rudders 22 relative to the bottom surface 24 of the multi-hull board 12 can assist in controlling at least the direction of propulsion of the standup paddle board system 10.

The multi-hull board 12 can have a top surface 20 that is shaped in order to allow a user to stand on the top surface 20, such as having a generally flat top surface 20. In addition, the top surface 20 can include features for assisting the user with standing on the multi-hull board 12, such as one or more traction pads.

Figure 3:
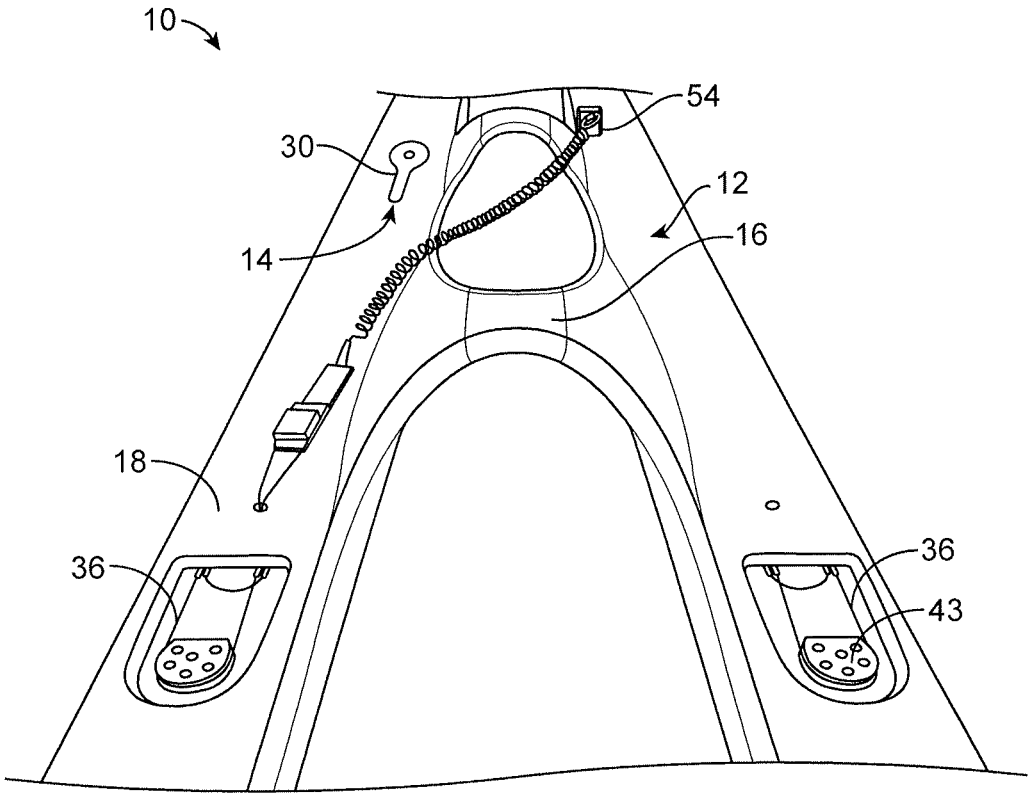
FIG. 3 shows a partial perspective top view of the standup paddle board system shown in FIG. 1 showing a part of the steering mechanism.

In at least some variations, the steering mechanism 14 can include a steering arm 30 functionally coupled to a top surface 20 of the multi-hull board 12, as shown in FIG. 3. The steering arm 30 can assist in controlling the movement and positioning of the moveable rudders 22, such as either mechanically or wirelessly. For example, the user can actuate or move the steering arm 30 which can effectuate movement of at least one moveable rudder 22, including simultaneous movement of at least two moveable rudders 22.

In addition, the steering arm 30 can be shaped and positioned such that a user can actuate the steering arm 30 without significantly disrupting the user's performance while using the standup paddle board system 10. For example, a user's performance can be disrupted if the user has to significantly alter the user's body positioning or interrupt paddling.

In some embodiments, the standup paddle board system 10 can include more than one steering arm 30. For example, the standup paddle board system 10 can have more than one steering arm 30 positioned in more than one location which can be manipulated by at least one foot or hand of the user. In addition, any number of mechanisms can be implemented in the steering mechanism 14 in order to allow a user to control the movement and positioning of the one or more moveable rudders 22, including either hand or foot actuated remote controllers, as will be discussed below.

In at least some variations, the steering arm 30 can be mechanically coupled to at least one moveable rudder 22 by at least one steering connector 36. In addition, any one moveable rudder 22 can be functionally coupled to a rudder controller 34 (see FIG. 5) which can be configured to mechanically interact with the one or more steering connectors 36. Additionally, the one or more steering connectors 36 can be configured and arranged in any number of a variety of ways, including configurations which allow the steering connectors to simultaneously change the position of two or more moveable rudders 22.

For example, the at least one steering connector 36 can be coupled to the steering arm 30 such that movement or actuation of the steering arm 30 can force the at least one steering connector 36 to travel in a direction. In addition, the at least one steering connector 36 can be functionally coupled to at least one rudder controller 43 such that movement of the at least one steering connector 36 causes movement, such as rotation, of the at least one rudder controller 43. Additionally, movement of the rudder controller 43 can effectuate a change in position of the associated moveable rudder 22. Furthermore, actuation of at least one steering arm 30 can allow the at least one steering connector 36 to cause the simultaneous change in position of at least two moveable rudders 22.

In at least some variations, the at least one steering connector 36 can be a cable, a pushrod, a chain or a wire which extends a distance between at least one steering arm 30 to at least one rudder controller 43. Furthermore, all or part of the steering connectors 36 can be contained within at least part of the multi-hull board 12 which may provide protection for at least a part of the steering connectors 36. Therefore, some implementations of the standup paddle board system 10 can enclose the steering connectors 36 within the multi-hull board 12 such that no parts of the steering connectors 36 are exposed.

As shown in FIG. 3, in at least some variations of the rudder controller 34 and steering connector 36 can be configured similar to a pulley mechanism. For example, at least a part of the steering connector 36 can extend around at least a part of the rudder controller 34 similar to a pulley mechanism. In this configuration, when a steering connector 36 is pulled in a direction it can cause at least one functionally mated rudder controller 34 to move, such as rotate along its center axis.

The moveable rudders 22 can have any number of shapes and sizes which can allow them to at least assist in maneuvering the standup paddle board system 10. Furthermore, any number of moveable rudders 22 may be included in the standup paddle board system 10. In general, the moveable rudders 22 can assist in controlling and changing the direction of travel of the standup paddle board system 10. Therefore, the steering mechanism 14 can provide a user with improved efficiency and maneuvering while standup paddling.

Figure 4:
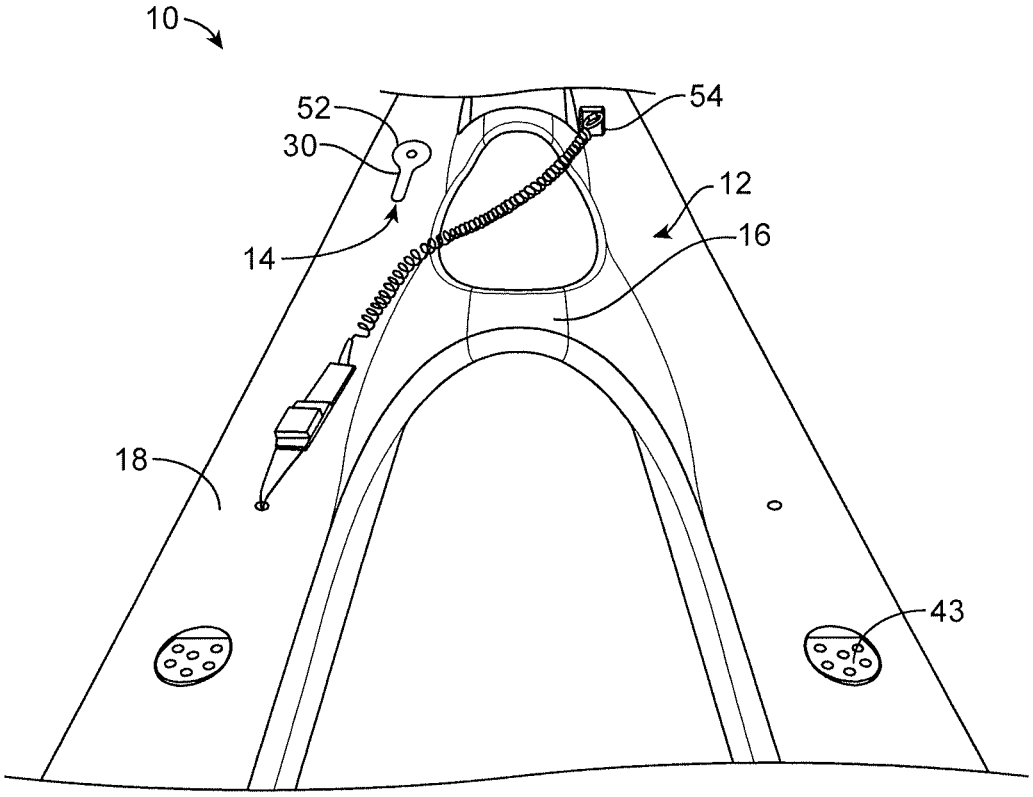
FIG. 4 shows a partial perspective top view of the standup paddle board system shown in FIG. 1 showing a part of the steering mechanism, including a remote controller for assisting in controlling the moveable rudders.
Figure 5:
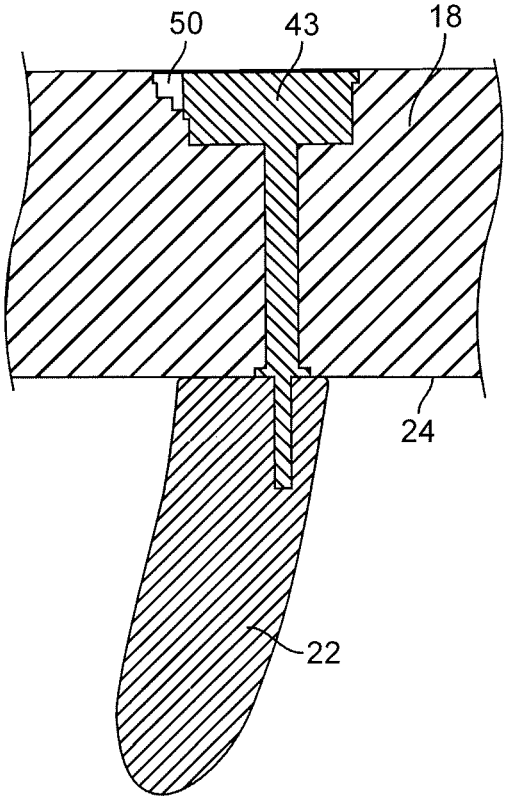
FIG. 5 shows a partial section view of the standup paddle board system shown in FIG. 1 showing a moveable rudder functionally coupled to a rudder controller.

As shown in FIGS. 4 and 5, some variations of the standup paddle board system 10 can include a steering mechanism which can be wirelessly controlled. For example, the standup paddle board system 10 can include at least one servo mechanism 50 which can wirelessly communicate with the at least one remote controller 52. In addition, the at least one servo mechanism 50 can control the movement of either the rudder controllers 43 or movable rudders 22. Therefore, the user can activate the remote controller 52 in order to instruct the at least one servo mechanism 50 to change the position of at least one moveable rudder 22, including simultaneously change the position of at least two moveable rudders 22.

For example, either a foot or a hand activated remote controller 52 can wirelessly control the at least one servo mechanism 50 configured to control the movement and positioning of the moveable rudders 22. In some variations, a remote controller 52 can be positioned along the multi-hull board 12 which can allow the user to control the remote controller 52 with the user's foot. For example, at least one remote controller 52 can be coupled to the top surface 20 of the multi-hull board 12, including integrated with a variation of the steering arm 30, as shown by way of example in FIG. 4, which can be activated by the user's foot.

Alternatively or in addition, the standup paddle board system 10 can include at least one remote controller 52 which can be activated by a user's hand. For example, at least one remote controller 52 can be positioned along a paddle (not shown) which can be held by the user and used to propel the standup paddle board system 10.

The one or more remote controllers 52 can allow the user to wirelessly control the position of the moveable rudders 20 and can include any number of features for allowing the user to control the positioning of the moveable rudders 22. For example, the remote controller 52 can include one or more buttons or sensors for allowing the user to control the position of the moveable rudders 22. The one or more remote controllers 52 can be positioned in any number of locations along the standup paddle board system 10 or included in an accessory of the standup paddle board system 10 in order to allow the user to easily manipulate the movement and positioning of the moveable rudders 22 without disrupting the user's performance.

In addition, any one pontoon or hull 18 can be an elongated vessel including any number of materials and can be constructed using any number of manufacturing methods. In general, the hulls 18 can provide floatation and assist the standup paddle board system 10 in traveling along a body of water, similar to a catamaran. The hulls 18 may be aligned parallel to each other or they may be angled relative to each other, such as shown by way of example in FIG. 2. Furthermore, the one or more connecting structures 16, or booms, may extend between the hulls 18 and can at least align and stabilize the position of the hulls 18 relative to each other. Additional features can also be included in the standup paddle board system 10, such as a leash 54 for releasably connecting the multi-hull board 12 to the user.

A method of use of the standup paddle board system 10 can include at least the following. For example, a user can stand atop the top surface 20 of the multi-hull board 12 and use a paddle to assist in propelling and maneuvering the standup paddle board system 10 along a body of water. In addition, the user may use one or both feet to actuate the steering arm 30 functionally coupled to the top surface 20 of the multi-hull board 12.

Upon actuation of the steering arm 30, the moveable rudders 22 can simultaneously change position, such as relative to the bottom surface of the multi-hull board 12. In some variations, the simultaneous change in position of the moveable rudders 22 can be caused by the steering arm 30 forcing steering connectors 36 in at least one direction which can force movement of the rudder controllers 43. Movement of the rudder controllers 43 can effectuate movement and a change in position of the associated moveable rudders 22 relative to the bottom surface 24 of the multi-hull board 12.

Furthermore, when the moveable rudders 22 move and change position relative to the bottom surface of the multi-hull board 12, they can assist in maneuvering and directing the direction of propulsion of the multi-hull board 12. Therefore, the ability of the user to change the direction of the moveable rudders 22 can assist the user in maneuvering and directing the standup paddle board system 10 along a body of water.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

What is claimed is:

1. A standup paddle board system comprising:

a multi-hull board including a first hull and a second hull joined by a connecting structure, the connecting structure extending a length between the first hull and the second hull for supporting and allowing a user to place a first foot on the first hull and a second foot on the second hull, the first hull and the second hull each comprising a front end, a rear end, an upper surface, a bottom surface, and side surfaces extending between the upper surface and the bottom surface, the multi-hull board further comprising a first moveable rudder extending from the bottom surface of the first hull and a second moveable rudder extending from the bottom surface of the second hull, the first moveable rudder and the second moveable rudder each spaced away from the rear end and located substantially midway between the connecting structure and the rear end, the first moveable rudder and the second moveable rudder each being pivotable about a substantially vertical axis and configured to steer the multi-hull board; and a steering mechanism including a steering arm configured to control the pivoting of the first moveable rudder and the second moveable rudder, the steering arm positioned along the upper surface of the first hull for controlling with the first foot, the steering mechanism further comprising a steering connector that extends between the steering arm and one or more rudder controllers that control the pivoting of at least one of the first moveable rudder and the second moveable rudder, the steering connector being substantially enclosed within the multi-hull board.

2. The standup paddle board system of claim 1, wherein the steering connector comprises at least one of a cord, a chain, a wire, or a pushrod.

3. The standup paddle board system of claim 1, wherein movement of the steering arm causes simultaneous pivoting of the first moveable rudder and the second moveable rudder.

4. The standup paddle board system of claim 1, further comprising a remote controlled servo mechanism configured to control the pivoting of at least one of the first moveable rudder and the second moveable rudder.

5. The standup paddle board system of claim 4, wherein the remote controlled servo mechanism is controlled by a remote controller positioned for activation by at least one of a hand, the first foot, and the second foot of the user.

6. The standup paddle board system of claim 5, wherein the remote controller is coupled to the steering arm for activation by the first foot of the user.

7. The standup paddle board system of claim 5, wherein activation of the remote controller causes the remote controlled servo mechanism to simultaneously pivot the first moveable rudder and the second moveable rudder.

8. The standup paddle board system of claim 1, wherein the connecting structure is located substantially proximate a midway point between the front end and the rear end.

9. A method of operating a standup paddle board system comprising:

providing a multi-hull board, wherein the multi-hull board includes a first hull and a second hull joined by a connecting structure, the connecting structure extending a length between the first hull and the second hull for supporting and allowing a user to place a first foot on the first hull and a second foot on the second hull, the first hull and the second hull each comprising a front end, a rear end, an upper surface, a bottom surface, and side surfaces extending between the upper surface and the bottom surface, the multi-hull board further comprising a first moveable rudder extending from the bottom surface of the first hull and a second moveable rudder extending from the bottom surface of the second hull, the first moveable rudder and the second moveable rudder each spaced away from the rear end and located substantially midway between the connecting structure and the rear end, the first moveable rudder and the second moveable rudder each being pivotable about a substantially vertical axis and configured to steer the multi-hull board;

providing a steering mechanism, wherein the steering mechanism includes a steering arm configured to control the pivoting of the first moveable rudder and the second moveable rudder, the steering arm positioned along the upper surface of the first hull for controlling with the first foot, the steering mechanism further comprising a steering connector that extends between the steering arm and one or more rudder controllers that control the pivoting of at least one of the first moveable rudder and the second moveable rudder, the steering connector being substantially enclosed within the multi-hull board;

allowing a user to be supported on the multi-hull board; and actuating the steering mechanism for pivoting at least one of the first moveable rudder and the second moveable rudder.

10. The method of claim 9, wherein the actuating comprises moving the steering arm.

11. The method of claim 10, wherein the standup paddle board system further includes a remote controlled servo mechanism configured to control the pivoting of at least one of the first moveable rudder and the second moveable rudder.

12. The method of claim 11, wherein the actuating comprises remotely activating the remote controlled servo mechanism with a remote controller that is positioned for activation by at least one of a hand, the first foot, and the second foot of the user.

13. The method of claim 11, wherein actuating the steering mechanism causes simultaneous pivoting of the first moveable rudder and the second moveable rudder.

* * * * *